US011222600B2

(12) United States Patent
Lee et al.

(10) Patent No.: US 11,222,600 B2
(45) Date of Patent: Jan. 11, 2022

(54) SOURCE DRIVER AND DISPLAY DRIVING CIRCUIT INCLUDING THE SAME

(71) Applicant: Silicon Works Co., Ltd., Daejeon (KR)

(72) Inventors: Hae Won Lee, Cheongju-si (KR); Hyun Ho Cho, Incheon-si (KR); Jung Bae Yun, Daejeon-si (KR); Ju Young Shin, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/703,119

(22) Filed: Dec. 4, 2019

(65) Prior Publication Data

US 2020/0105207 A1 Apr. 2, 2020

Related U.S. Application Data

(63) Continuation-in-part of application No. 15/276,907, filed on Sep. 27, 2016, now abandoned.

(30) Foreign Application Priority Data

Oct. 1, 2015 (KR) ..... 10-2015-0138559

(51) Int. Cl.
*G09G 3/3291* (2016.01)

(52) U.S. Cl.
CPC ... *G09G 3/3291* (2013.01); *G09G 2320/0276* (2013.01)

(58) Field of Classification Search
CPC ..... G09G 3/18; G09G 3/20; G09G 3/2007; G09G 3/2077; G09G 3/36; G09G 3/3607; G09G 3/3685; G09G 3/3696; G09G 2310/027; G09G 2310/0291;
(Continued)

(56) References Cited

U.S. PATENT DOCUMENTS 6,157,360 A 12/2000 Jeong et al.
2002/0080054 A1 6/2002 Harada et al.
(Continued)

FOREIGN PATENT DOCUMENTS

JP 2006-004600 A 1/2006
KR 2011-0014428 A 2/2011
(Continued)

*Primary Examiner* — Roberto W Flores
(74) *Attorney, Agent, or Firm* — Polsinelli PC

(57) ABSTRACT

Disclosed are a source driver capable of achieving high speed and high resolution and a display driving circuit including the same. The source driver may include: a first channel group and a second channel group configured to output source driving signals; a first gradation voltage divider configured to generate first gradation voltages using gamma reference voltages and provide the first gradation voltages to the first channel group; and a second gradation voltage divider configured to generate second gradation voltages having the same level as the first gradation voltages using the gamma reference voltages, and provide the second gradation voltages to the second channel group. The first and second gradation voltage dividers are connected to a gamma reference voltage generator configured to provide the gamma reference voltages, and receive the gamma reference voltages having the same voltage range from the gamma reference voltage generator.

10 Claims, 6 Drawing Sheets

(58) Field of Classification Search
CPC ..... G09G 2320/0223; G09G 3/0252; G09G 3/0271; G09G 3/0276; G09G 3/0673
See application file for complete search history.

(56) References Cited

U.S. PATENT DOCUMENTS

| | | | | |
|---|---|---|---|---|
| 2006/0255994 | A1* | 11/2006 | Lin | G09G 3/3688 341/144 |
| 2007/0171163 | A1 | 7/2007 | Miyata | |
| 2010/0225571 | A1 | 9/2010 | Sakariya | |
| 2011/0032279 | A1 | 2/2011 | Kim et al. | |
| 2011/0074754 | A1* | 3/2011 | Lee | G09G 3/2003 345/211 |
| 2011/0199400 | A1 | 8/2011 | Ikeda et al. | |
| 2011/0227891 | A1 | 9/2011 | Lee | |
| 2013/0106925 | A1 | 5/2013 | Sasaki | |
| 2014/0133058 | A1 | 5/2014 | Huang et al. | |
| 2014/0266835 | A1 | 9/2014 | Price et al. | |
| 2015/0213751 | A1 | 7/2015 | Lee et al. | |
| 2017/0098423 | A1* | 4/2017 | Tang | G09G 3/3688 |

FOREIGN PATENT DOCUMENTS

| | | | |
|---|---|---|---|
| KR | 10-1148222 | B1 | 7/2012 |
| KR | 10-1174985 | B1 | 8/2012 |
| KR | 10-1605478 | B1 | 3/2016 |

* cited by examiner

SOURCE DRIVER AND DISPLAY DRIVING CIRCUIT INCLUDING THE SAME

CROSS-REFERENCE TO RELATED APPLICATIONS

The present application is a continuation in part application to U.S. application Ser. No. 15/276,907, filed Sep. 27, 2016, which claims priority to Korean Application No. 10-2015-0138559 filed Oct. 1, 2015 the contents of which are hereby incorporated by reference as set for fully herein.

BACKGROUND

1. Technical Field

The present disclosure relates to a display device, and more particularly, to a source driver capable of achieving high speed and high resolution and a display driving circuit including the same.

2. Related Art

In general, a display device includes a display panel, a gate driver, a source driver and a timing controller.

The display panel includes a gate line and a data line, the gate driver supplies a gate driving signal to the gate line, and the source driver supplies a source driving signal to the data line. The timing controller provides display data to the source driver. The display data include pixel data.

The source driver forms a large number of channels for providing source driving signals corresponding to the display data to the display panel, and digital-to-analog converters (DACs) and buffers are installed at the respective channels.

The source driver according to the related art includes one resistor string which generates gradation voltages using a gamma reference voltage, and the resistor string commonly provides the gradation voltages to the DACs of the respective channels.

The DACs of the respective channels convert pixel data into data voltages using the gradation voltages, and the buffers of the respective channels provide the data voltages as the source driving signals to the display panel.

In the source driver according to the related art, however, one resistor string covers a large number of channels. Thus, the parasitic capacitors of the respective channels and the parasitic capacitors of the input transistors of the buffers cause RC delay, thereby having an influence on the output of the source driving signals.

Therefore, the related art is difficult to apply to a high-speed and high-resolution display device.

SUMMARY

Various embodiments are directed to a source driver capable of reducing a parasitic capacitor which serves as a load of a resistor string and a display driving circuit including the same.

Also, various embodiments are directed to a source driver capable of improving an output slew rate by reducing RC delay caused by a parasitic capacitor and a display driving circuit including the same.

Also, various embodiments are directed to a source driver which can be applied to a high-speed and high-resolution display device due to an improvement of an output slew rate and a display driving circuit including the same.

Also, various embodiments are directed to a source driver which includes first and second gradation voltage dividers therein to balance loads of channels, and thus improve a charging characteristic, and a display driving circuit including the same.

In an embodiment, a display driving circuit may include: a gradation voltage generation unit including a plurality of resistor strings corresponding to a plurality of groups into which channels corresponding to display data are grouped, the plurality of resistor strings being configured to provide gradation voltages to digital-analog converters (DACs) corresponding to the respective channels of the corresponding groups; and a display driving unit including the DACs and buffers corresponding to the respective channels, wherein the DACs convert the corresponding display data into data voltages using the gradation voltages, and the buffers provide the corresponding data voltages as source driving signals to a display panel.

In an embodiment, a display driving circuit may include: a first resistor string configured to provide gradation voltages to DACs of odd-numbered channels among a plurality of channels corresponding to display data; a second resistor string configured to provide the gradation voltages to DACs of even-numbered channels among the plurality of channels; a DAC unit including the DACs corresponding to the respective channels, the DACs being configured to convert the corresponding display data into data voltages using the gradation voltages; and an output buffer unit including buffers corresponding to the respective DACs, the buffers being configured to provide the corresponding data voltages as source driving signals to a display panel.

In an embodiment, a display driving circuit may include: a first resistor string configured to provide gradation voltages to DACs of left channels based on the center of two parts into which channels corresponding to display data are divided into an equal number; a second resistor string configured to provide the gradation voltages to DACs of right channels based on the center; a DAC unit including the DACs corresponding to the respective channels, the DACs being configured to convert the corresponding display data into data voltages using the gradation voltages; and an output buffer unit including buffers corresponding to the respective DACs, the buffers being configured to provide the corresponding data voltages as source driving signals to a display panel.

In an embodiment, a source driver may include: a first channel group and a second channel group configured to output source driving signals; a first gradation voltage divider configured to generate first gradation voltages using gamma reference voltages and provide the first gradation voltages to the first channel group; and a second gradation voltage divider configured to generate second gradation voltages having the same level as the first gradation voltages using the gamma reference voltages, and provide the second gradation voltages to the second channel group. The first and second gradation voltage dividers are connected to a gamma reference voltage generator configured to provide the gamma reference voltages, and receive the gamma reference voltages having the same voltage range from the gamma reference voltage generator.

In an embodiment, a display driving device may include: a gamma reference voltage generator configured to provide gamma reference voltages; a first source driver comprising: a first gradation voltage divider configured to generate first gradation voltages using the gamma reference voltages and provide the first gradation voltages to a first channel group; and a second gradation voltage divider configured to generate second gradation voltages having the same level as the first gradation voltage using the gamma reference voltages and provide the second gradation voltages to a second channel group; and a second source driver comprising: a third gradation voltage divider configured to generate third gradation voltages using the gamma reference voltages and provide the third gradation voltages to a third channel group; and a fourth gradation voltage divider configured to generate fourth gradation voltages having the same level as the third gradation voltage using the gamma reference voltages and provide the fourth gradation voltages to a fourth channel group. The first to fourth gradation voltage dividers may be connected to the gamma reference voltage generator.

DETAILED DESCRIPTION

Figure 1:
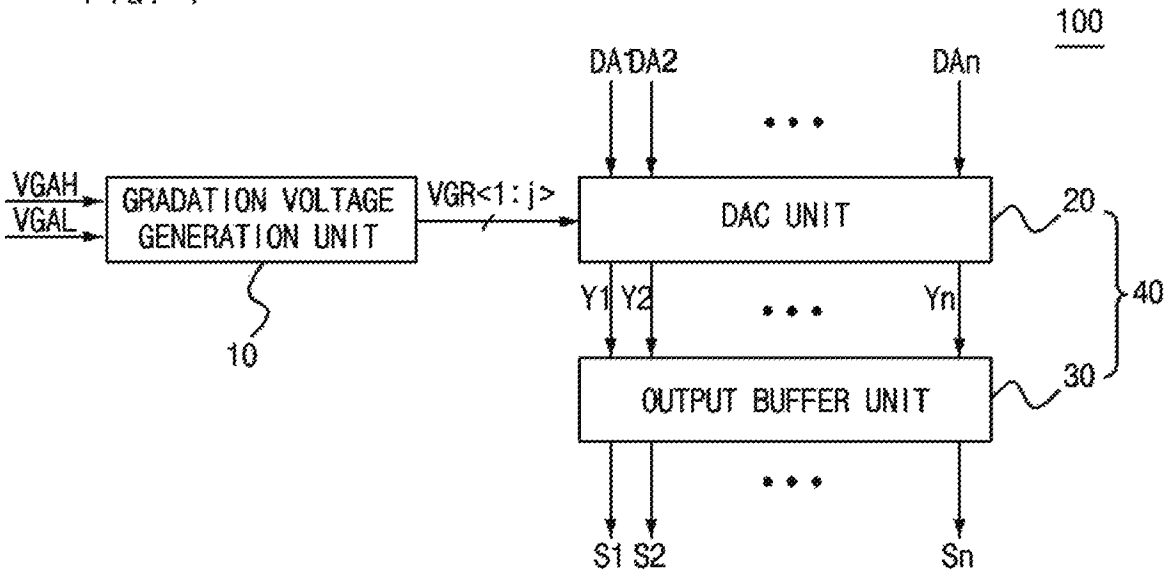
FIG. 1 is a block diagram illustrating a display driving circuit according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a block diagram illustrating a display driving circuit according to an embodiment of the present invention.

Referring to FIG. 1, the display driving circuit 100 according to the embodiment of the present invention includes a gradation voltage generation unit 10 and a display driving unit 40. The display driving circuit 100 may be configured as a source driver.

The gradation voltage generation unit 10 includes a plurality of resistor strings 12 and 14 (refer to FIGS. 2 and 3), receives gamma reference voltages VGAH and VGAL provided from outside, and generates gradation voltages VGR1 to VGRj using the gamma reference voltages VGAH and VGAL.

The gamma reference voltage VGAH indicates a high-level reference voltage for generating the gradation voltages VGR1 to VGRj, and the gamma reference voltage VGAL indicates a low-level reference voltage for generating the gradation voltages. The gamma reference voltages VGAH and VGAL may have the same polarity or different polarities, and the gamma reference voltage VGAH may have a higher electrical potential than the gamma reference voltage VGAL.

The plurality of resistor strings 12 and 14 of the gradation voltage generation unit 10 share the gamma reference voltages VGAH and VGAL, and generate the gradation voltages VGR1 to VGRj using divided voltages between the gamma reference voltage VGAH and the gamma reference voltage VGAL.

In the present embodiment, it has been described that the gradation voltage generation unit 10 generates the gradation voltages VGR1 to VGRj using the two gamma reference voltages VGAH and VGAL. However, depending on the type of a display panel, the gamma reference voltages VGAH and VGAL may be divided into a plurality of steps such as three or ten steps, and the gradation voltage generation unit 10 may generate the gradation voltages VGR1 to VGRj using the gamma reference voltages divided into a plurality of steps.

The gradation voltages VGR1 to VGRj are used when a digital-to-analog conversion (DAC) unit 20 converts display data DA1 to DAn into data voltages Y1 to Yn.

The display driving circuit 100 forms a plurality of channels for providing source driving signals S1 to Sn corresponding to the display data DA1 to DAn to the display panel.

The plurality of channels may be grouped into one or more groups, and one resistor string may be matched with one group. Each of the resistor strings independently provides the gradation voltages VGR1 to VGRj to DACs 22 of the respective channels of the corresponding groups.

For example, the channels may be grouped into odd-numbered channels and even-numbered channels, and each of the resistor strings matched with the odd-numbered channels and the even-numbered channels independently provides the gradation voltages VGR1 to VGRj to the DACs 22 of the corresponding channels.

The channels may be grouped into the left channels and the right channels based on the center of two parts into which the channels are divided into an equal number, and each of the resistor strings which are matched with the left channels and the right channels independently provides the gradation voltages VGR1 to VGRj to the DACs 22 of the respective channels of the corresponding groups.

Alternatively, the channels may be grouped into left odd-numbered channels, right even-numbered channels, left even-numbered channels and right odd-numbered channels, based on the center of two parts into which the channels are divided into the equal number, and each of resistor strings which are matched with the left odd-numbered channels, the right even-numbered channels, the left even-numbered channels and the right odd-numbered channels may independently provide the gradation voltages VGR1 to VGRj to the DACs 22 of the respective channels of the corresponding groups.

As such, the plurality of resistor strings 12 and 14 are matched to the respective groups, and independently provide the gradation voltages VGR1 to VGRj to the DACs 22 of the respective channels of the corresponding groups.

In another embodiment, the channels may be grouped in a different manner, and the resistor strings may be matched with the respective groups, and independently provide the gradation voltages VGR1 to VGRj to the DACs 22 of the respective channels of the corresponding groups.

The plurality of resistor strings 12 and 14 may be arranged between two parts into which the channels divided into the equal number, such that no deviation occurs in the gradation voltages VGR1 to VGRj provided to the DACs 22 of the channels.

For example, when the display driving circuit 100 forms eight channels, the plurality of resistor strings 12 and 14 may be arranged between four channels and four channels into which the eight channels are divided. Furthermore, the plurality of resistor strings 12 and 14 may be arranged in the center of the two parts into which the channels are divided.

The present invention is not limited thereto, but the plurality of resistor strings 12 and 14 may be arranged at positions where the distances from the resistor string 12 to the DACs 22 of the corresponding channels are equal to the distances from the resistor string 14 to the DACs 22 of the corresponding channels, respectively.

Each of the resistor strings 12 and 14 provides the gradation voltages VGR1 to VGRj to an equal number of DACs 22, and generates the gradation voltages VGR1 to VGRj having the same level using the shared gamma reference voltages VGAH and VGAL.

The display driving unit 40 converts the display data DA1 to DAn of the respective channels into the corresponding data voltages Y1 to Yn, using the gradation voltages VGR1 to VGRj provided from the gradation voltage generation unit 10, and provides the data voltages Y1 to Yn as the source driving signals S1 to Sn to the display panel.

The display driving unit 40 includes the DAC unit 20 and an output buffer unit 30.

The DAC unit 20 includes the DACs 22 corresponding to the respective channels, and the DACs 22 convert the corresponding display data DA1 to DAn into the data voltages Y1 to Yn, using the gradation voltages VGR1 to VGRj.

The output buffer unit 30 includes buffers 32 corresponding to the respective DACs 22, and the buffers 32 provide the corresponding data voltages Y1 to Yn as the source driving signals S1 to Sn to the display panel.

As described above, the plurality of resistor strings 12 and 14 independently provide the gradation voltages VGR1 to VGRj to the DACs 22 of the respective channels of the corresponding groups. Thus, a parasitic capacitor serving as a load of the gradation voltage generation unit 10 can be reduced to a half of the parasitic capacitor in the related art.

Therefore, the display driving circuit according to the present embodiment can improve an output slew rate by reducing RC delay caused by the parasitic capacitor. Therefore, the display driving circuit can be applied to a high-speed and high-resolution display device, due to the improvement of the output slew rate.

Although not illustrated in FIG. 1, the display driving circuit 100 may include a data restoration unit (not illustrated) for restoring the display data DA1 to DAn provided from a timing controller (not illustrated) and a latch unit (not illustrated) for latching the display data DA1 to DAn.

Figure 2:
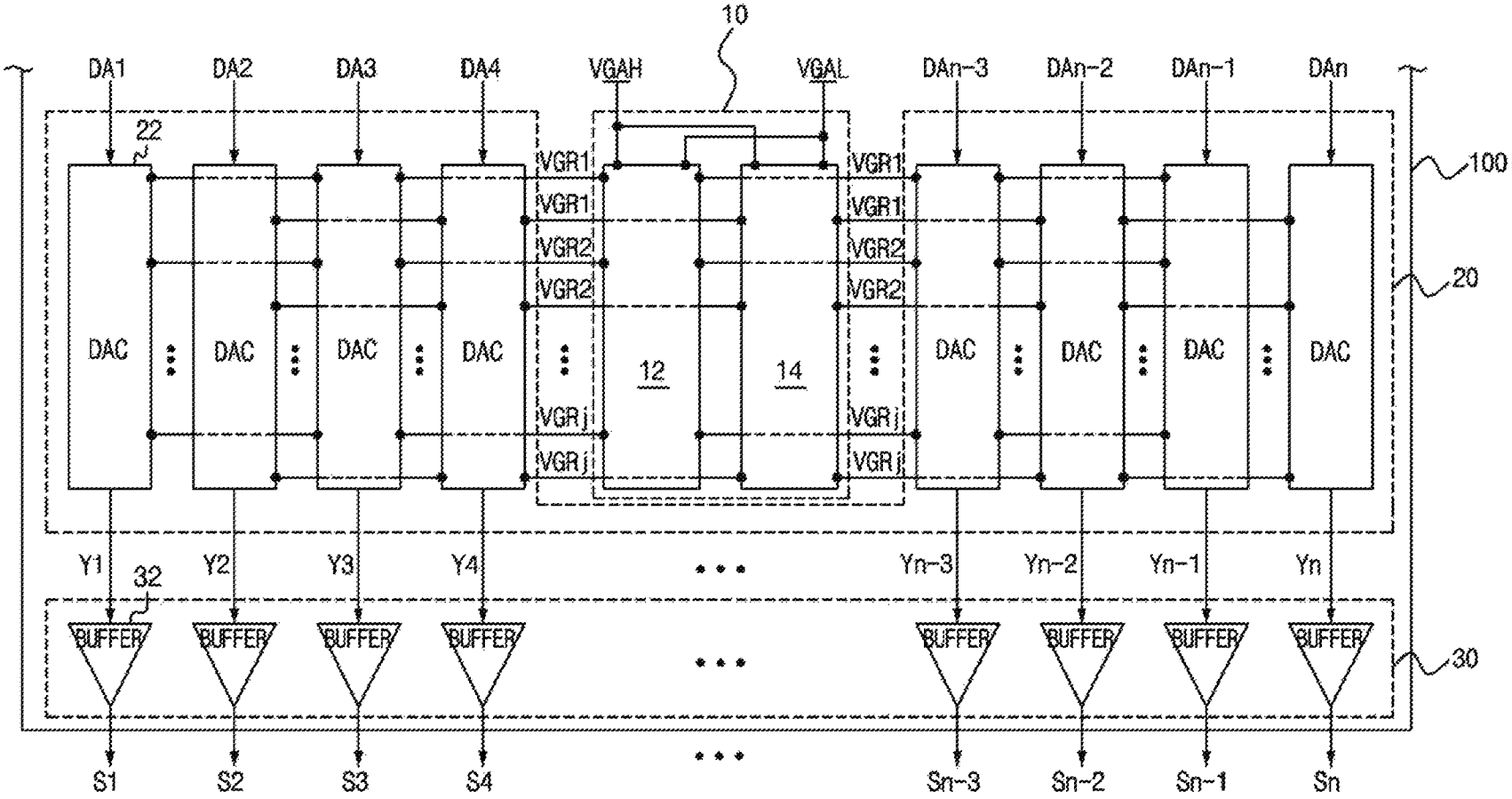
FIG. 2 is a circuit diagram for describing the display driving circuit of FIG. 1.

FIG. 2 is a circuit diagram for describing the display driving circuit of FIG. 1.

Referring to FIG. 2, the display driving circuit 100 according to the present embodiment includes the resistor string 12, the resistor string 14, the DAC unit 20 and the output buffer unit 30.

The resistor string 12 independently provides the gradation voltages VGR1 to VGRj to the DACs 22 of the odd-numbered channels among the channels corresponding to the display data DA1 to DAn, and the resistor string 14 independently provides the gradation voltages VGR to VGRj to the DACs 22 of the even-numbered channels among the channels corresponding to the display data DA1 to DAn.

The resistor strings 12 and 14 are arranged between two parts into which the channels are divided into an equal number, share the gamma reference voltages VGAH and VGAL provided form outside, and independently generate the gradation voltages VGR1 to VGRj using the shared gamma reference voltages VGAH and VGAL. The present invention is not limited thereto, but the resistor strings 12 and 14 may be arranged at positions where the distances from the resistor string 12 to the DACs 22 of the corresponding channels are equal to the distances from the resistor string 14 to the DACs 22 of the corresponding channels, respectively.

Each of the resistor strings 12 and 14 includes a plurality of resistors (not illustrated) which are sequentially coupled in series between the gamma reference voltages VGAH and VGAL, and generates the gradation voltages VGR1 to VGRj using node voltages between the respective resistors.

The DAC unit 20 includes the DACs 22 corresponding to the respective channels, and the DACs 22 include switches (not illustrated) for selecting the gradation voltages VGR1 to VGRj in response to the corresponding display data DA1 to DAn.

The DACs 22 corresponding to the respective channels convert the display data DA1 to DAn into the data voltages Y1 to Yn, using the gradation voltages VGR1 to VGRj provided from the resistor string 12 or 14.

The output buffer unit 30 includes buffers 32 corresponding to the DACs 22, and the buffers 32 provide the corresponding data voltages Y1 to Yn as the source driving signals S1 to Sn to the display panel.

As described above, the resistor strings 12 and 14 independently provide the gradation voltages VGR1 to VGRj to the DACs 22 of the even-numbered channels and the odd-numbered channels, respectively. Thus, a parasitic capacitor serving as a load of the resistor strings 12 and 14 can be reduced to a half of the parasitic capacitor in the related art.

Therefore, the display driving circuit according to the present embodiment can improve an output slew rate by reducing RC delay caused by the parasitic capacitor. Due to the improvement of the output slew rate, the display driving circuit can be applied to a high-speed and high-resolution display device.

Figure 3:
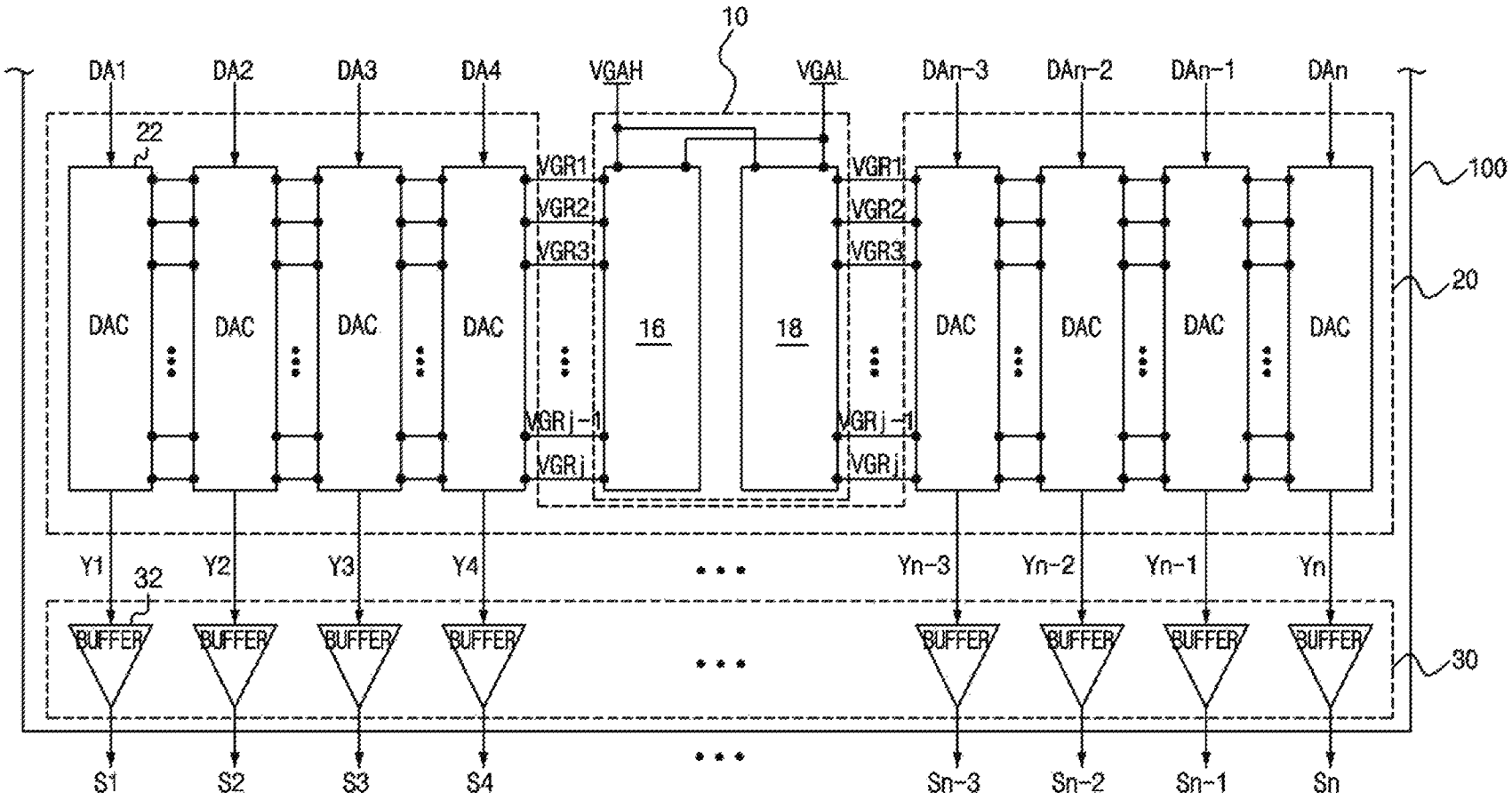
FIG. 3 is a circuit diagram for describing another embodiment of the display driving circuit of FIG. 1.

FIG. 3 is a circuit diagram for describing another embodiment of the display driving circuit of FIG. 1.

Referring to FIG. 3, the display driving circuit according to the present embodiment includes a resistor string 16, a resistor string 18, a DAC unit 20 and an output buffer unit 30.

The resistor string 16 independently the provides gradation voltages VGR1 to VGRj to the DACs 22 of the left channels which are arranged in the left side based on the center of two parts into which the channels corresponding to display data DA1 to DAn are divided, and the resistor string 18 independently provides the gradation voltages VGR1 to VGRj to the DACs 22 of the right channels which are arranged in the right side based on the center.

The resistor strings 16 and 18 are arranged between the two parts into which the channels are divided into an equal number, share gamma reference voltages VGAH and VGAL provided form outside, and independently generate the gradation voltages VGR1 to VGRj using the shared gamma reference voltages VGAH and VGAL. The present invention is not limited thereto, but the plurality of resistor strings 16 and 18 may be arranged at positions where the distances from the resistor string 12 to the DACs 22 of the corresponding channels are equal to the distances from the resistor string 14 to the DACs 22 of the corresponding channels, respectively.

Each of the resistor strings 16 and 18 includes a plurality of resistors (not illustrated) which are sequentially coupled in series between the gamma reference voltages VGAH and VGAL, and generates the gradation voltages VGR1 to VGRj using node voltages between the respective resistors.

The DAC unit 20 includes the DACs 22 corresponding to the respective channels, and the DACs 22 include switches (not illustrated) for selecting the gradation voltages VGR1 to VGRj in response to the corresponding display data DA1 to DAn.

The DACs 22 corresponding to the respective channels convert the display data DA1 to DAn into the data voltages Y1 to Yn, using the gradation voltages VGR1 to VGRj provided from the resistor string 16 or 18.

The output buffer unit 30 includes buffers 32 corresponding to the DACs 22, and the buffers 32 provide the corresponding data voltages Y1 to Yn as the source driving signals S1 to Sn to a display panel.

As described above, the resistor strings 16 and 18 independently provide the gradation voltages VGR1 to VGRj to the DACs 22 of the left channels and the right channels, respectively. Thus, a parasitic capacitor serving as a load of the resistor strings 16 and 18 can reduced to a half of the parasitic capacitor in the related art.

Therefore, the display driving circuit according to the present embodiment can improve an output slew rate by reducing RC delay caused by the parasitic capacitor. Due to the improvement of the output slew rate, the display driving circuit can be applied to a high-speed and high-resolution display device.

Figure 4:
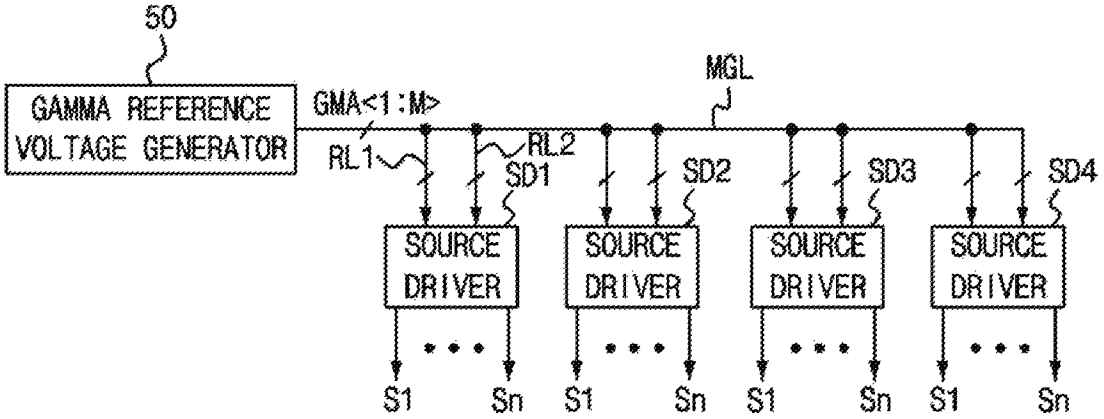
FIG. 4 is a block diagram illustrating a display driving circuit according to an embodiment of the present invention.

FIG. 4 is a block diagram illustrating a display driving circuit 100 according to an embodiment of the present invention.

The present embodiment provides a source driver which includes two gradation voltage dividers to balance loads of channels and thus can improve a charging characteristic, and a display driving circuit including the same.

Referring to FIG. 4, the display driving circuit 100 may include a gamma reference voltage generator 50 and a plurality of source drivers SD1 to SD4.

The gamma reference voltage generator 50 provides a plurality of gamma reference voltages GMA<1:M> to the source drivers SD1 to SD4. Each of the source drivers SD1 to SD4 may include a first gradation voltage divider 22 and a second gradation voltage divider 24.

The gamma reference voltage generator 50 is connected to the first and second gradation voltage dividers of each of the source drivers SD1 to SD4. The gamma reference voltage generator 50 may provide the gamma reference voltages GMA<1:M> to the first and second gradation voltage dividers of each of the source drivers SD1 to SD4.

The source drivers SD1 to SD4 may generate gradation voltages using the gamma reference voltages GMA<1:M>, and provide source driving signals S1 to Sn corresponding to display data to a display panel (not illustrated) using the gradation voltages.

One source driver may be integrated as one chip, and the number of source drivers may be decided according to the resolution of the display panel (not illustrated). FIG. 4 illustrates four source drivers, but the present invention is not limited thereto.

Each of the source drivers SD1 to SD4 may include the first and second gradation voltage dividers 22 and 24. The first gradation voltage divider 22 may be connected to the gamma reference voltage generator 50 through a first branch line RL1 diverging from main gamma lines MGL, and the second gradation voltage divider 24 may be connected to the gamma reference voltage generator 50 through a second branch line RL2 diverging from the main gamma lines MGL.

The first and second gradation voltage dividers of the source drivers SD1 to SD4 may be directly connected to the gamma reference voltage generator 50, and receive the gamma reference voltages GMA<1:M> from the gamma reference voltage generator 50.

Figure 5:
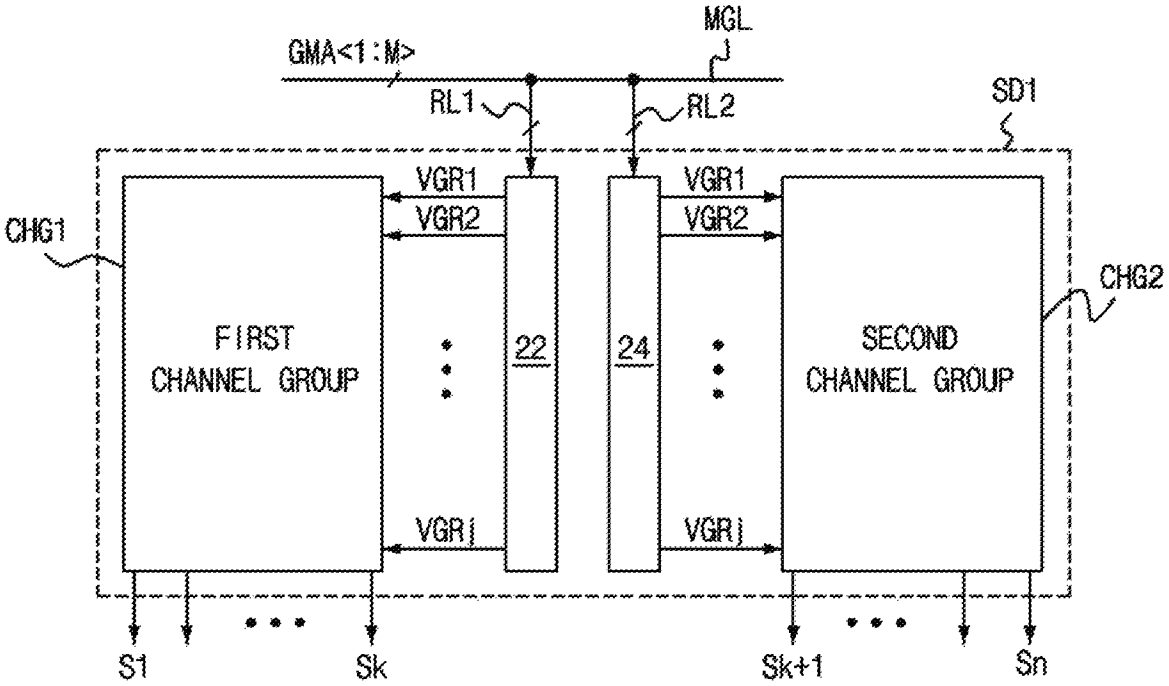
FIG. 5 is a block diagram illustrating a source driver according to an embodiment of the present invention.

FIG. 5 is a block diagram illustrating the source driver SD1 according to the embodiment of the present invention. The source drivers have the same configuration, and FIG. 5 illustrates only one source driver SD1, for convenience of description.

Referring to FIG. 5, the source driver SD1 may include the first gradation voltage divider 22, the second gradation voltage divider 24, a first channel group CHG1 and a second channel group CHG2.

The first gradation voltage divider 22 receives the gamma reference voltages GMA<1:M> from the gamma reference voltage generator 50, generates first gradation voltages VGR1 to VGRj using the gamma reference voltages GMA<1:M>, and provides the first gradation voltages VGR1 to VGRj to the first channel group CHG1.

The first gradation voltage divider 22 may be connected to the gamma reference voltage generator 50 through the first branch line RL1 diverging from the main gamma lines MGL. For example, the first gradation voltage divider 22 may be configured as a resistor string.

The second gradation voltage divider 24 receives the gamma reference voltages GMA<1:M> from the gamma reference voltage generator 50, generates second gradation voltages VGR1 to VGRj using the gamma reference voltages GMA<1:M>, and provides the second gradation voltages VGR1 to VGRj to the second channel group CHG2.

The second gradation voltage divider 24 may be connected to the gamma reference voltage generator 50 through the second branch line RL2 diverging from the main gamma lines MGL. For example, the second gradation voltage divider 24 may be configured as a resistor string.

The first gradation voltage divider 22 and the second gradation voltage divider 24 may receive the gamma reference voltages GMA<1:M> having the same voltage range from the gamma reference voltage generator 50. For example, the gamma reference voltages GMA<1:M> may include a range from a first gamma voltage VGL to a second gamma voltage VGM and a range from the second gamma voltage VGM to a third gamma voltage VGH. The first gamma voltage VGL may be set to a lower level than the second gamma voltage VGM, and the second gamma voltage VGM may be set to a lower level than the third gamma voltage VGH, and set to an intermediate level between the first and third gamma voltages VGL and VGH. The first and second gradation voltage dividers 22 and 24 may receive the gamma reference voltages GMA<1:M> having the voltage range from the first gamma voltage VGL to the third gamma voltage VGH.

The first and second gradation voltage dividers 22 and 24 may generate the first and second gradation voltages VGR1 to VGRj having the same polarity and level using the gamma reference voltages GMA<1:M> provided through the first and second branch lines RL1 and RL2 from the gamma reference voltage generator 50.

In this way, the first and second gradation voltage dividers 22 and 24 within one source driver SD1 can balance loads of channels allocated to the source driver SD1.

The first channel group CHG1 may be connected one-to-one to the first gradation voltage divider 22, and the second channel group CHG2 may be connected one-to-one to the second gradation voltage divider 24.

For example, the first channel group CHG1 may include odd channels among the channels allocated to the source driver SD1, and the second channel group CHG2 may include even channels among the channels allocated to the source driver SD1.

The first gradation voltage divider 22 may be connected to the odd channels among the channels allocated to the source driver SD1, and the second gradation voltage divider 24 may be connected to the even channels among the channels allocated to the source driver SD1.

For another example, the first and second gradation voltage dividers 22 and 24 may be disposed between two parts obtained by dividing the channels by the same number of channels. The first channel group CHG1 may include left channels disposed on the left side based on the first and second gradation voltage dividers 22 and 24, and the second channel group CHG2 may include right channels disposed on the right side based on the first and second gradation voltage dividers 22 and 24.

The first gradation voltage divider 22 may be connected to the left channels among the channels allocated to the source driver SD1, and the second gradation voltage divider 24 may be connected to the right channels among the channels allocated to the source driver SD1.

The first and second channel groups CHG1 and CHG2 convert display data into source driving signals, and provide the source driving signals to the display panel. Although not illustrated in FIG. 5, each of the channels of the first and second channel groups CHG1 and CHG2 may include a DAC and an output buffer.

The DACs of the respective channels may convert the display data into the corresponding source driving signals using gradation voltages, and the output buffers of the respective channels may output the source driving signals outputted from the DACs to the display panel.

The first and second gradation voltage dividers 22 and 24 included in one source driver SD1 may balance the loads of the channels, i.e. the loads of the DACs, thereby improving the charging characteristic.

Figure 6:
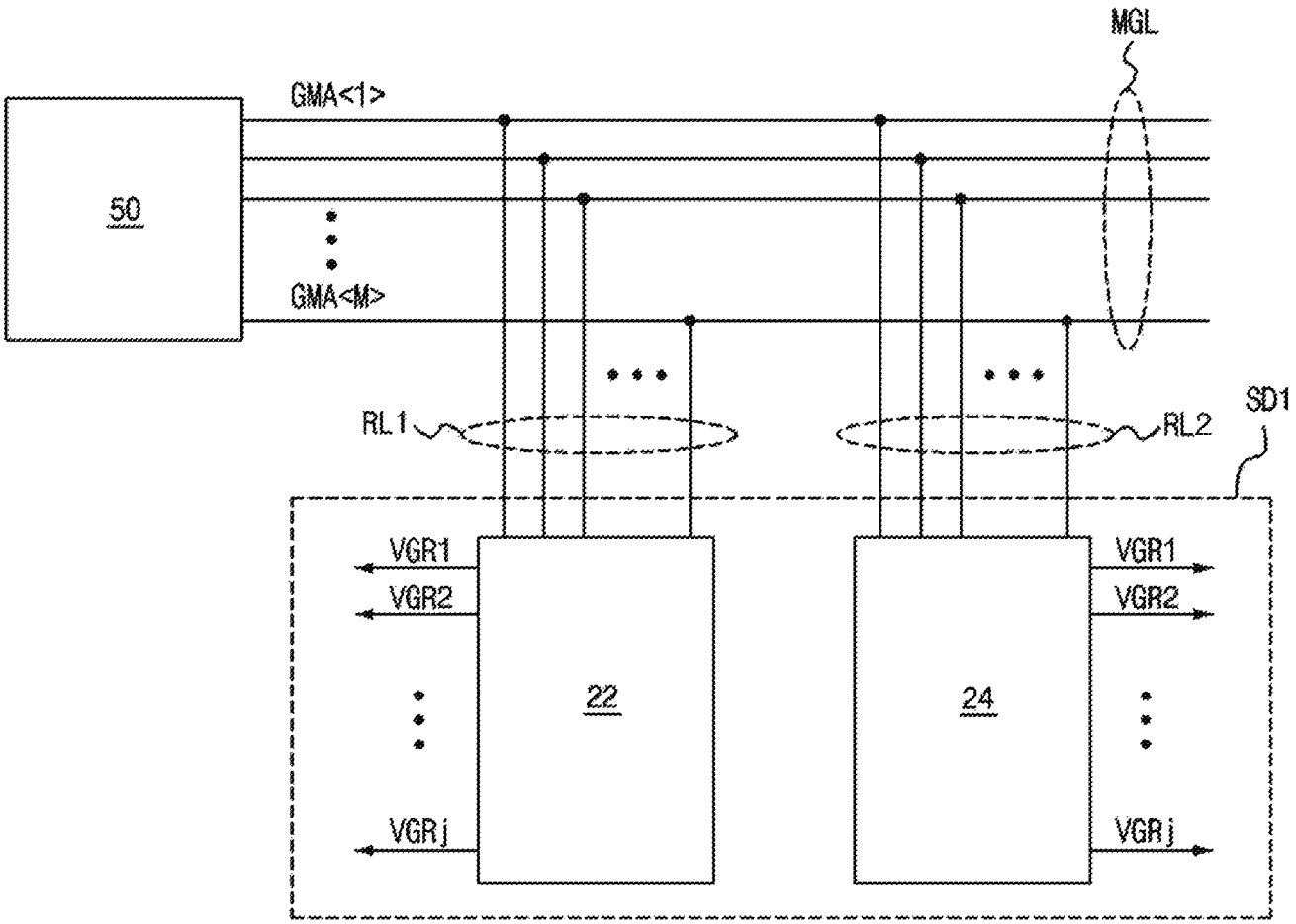
FIG. 6 is a block diagram illustrating a connection relation between first and second gradation voltage dividers and a gamma reference voltage generator according to the embodiment of the present invention.

FIG. 6 is a block diagram for describing a connection relation between the first and second gradation voltage dividers 22 and 24 and the gamma reference voltage generator 50 according to the embodiment of the present invention.

Referring to FIG. 6, the first gradation voltage divider 22 is connected to the gamma reference voltage generator 50 through the first branch lines RL1 diverging from the main gamma lines MGL, and the second gradation voltage divider 24 is connected to the gamma reference voltage generator 50 through the second branch lines RL2 diverging from the main gamma lines MGL.

The first branch lines RL1 are connected in parallel between the first gradation voltage divider 22 and the gamma reference voltage generator 50, and the second branch lines RL2 are connected in parallel between the second gradation voltage divider 24 and the gamma reference voltage generator 50.

The total resistance value of the first and second branch lines RL1 and RL2 between the first and second gradation voltage dividers 22 and 24 and the gamma reference voltage generator 50 may be reduced by line resistors connected in parallel.

As such, a line resistance value between the first gradation voltage divider 22 and the gamma reference voltage generator 50 and a line resistance value between the second gradation voltage divider 24 and the gamma reference voltage generator 50 may be reduced more than in the related art in which one resistor string is used.

The gamma reference voltages GMA<1:M> can be transferred to the first and second gradation voltage dividers 22 and 24 through the first and second branch lines RL1 and RL2 at high speed, due to the reduction in line resistance value.

The gamma reference voltage generator 50 can provide the gamma reference voltages GMA<1:M> to the first gradation voltage divider 22 through the first branch lines RL1 at high speed, and provide the gamma reference voltages GMA<1:M> to the second gradation voltage divider 24 through the second branch lines RL2 at high speed.

For example, the present embodiments may be employed in a display device which drives an organic light emitting diode panel. The first and second gradation voltage dividers 22 and 24 may be independently operated within one source driver, and serve to balance the loads of the channels, for example, the loads of the DACs.

In the present embodiments, the two first and second gradation voltage dividers 22 and 24 may be configured in one source driver SD1 to balance the loads of the channels, thereby improving the charging characteristics.

Furthermore, since the first and second gradation voltage dividers 22 and 24 are connected to the gamma reference voltage generator 50 through the first and second branch lines RL1 and RL2 diverging from the main gamma lines, the resistance value between the gamma reference voltage generator 50 and the first and second gradation voltage dividers 22 and 24 can be reduced.

Furthermore, the present embodiments can improve the speed by balancing the loads of the channels and reducing the line resistance value, thereby implementing a high-speed and high-resolution display device.

According to the embodiments of the present invention, the channels allocated to one source driver are grouped into a plurality of groups, and the gradation voltages are independently provided to the respective groups. Thus, the display driving circuit can reduce a parasitic capacitor serving as a load of the resistor strings.

Furthermore, the display driving circuit can improve the output slew rate by reducing RC delay caused by a parasitic capacitor, and can be applied to a high-speed and high-resolution display device due to the improvement of the output slew rate.

Furthermore, the two first and second gradation voltage dividers may be configured in one source driver to balance the loads of the channels, thereby improving the charging characteristics.

Moreover, the first and second gradation voltage dividers within one source driver are connected to the gamma reference voltage generator through the first and second branch lines diverging from the main gamma lines, which makes it possible to reduce the resistance value between the gamma reference voltage generator and the first and second gradation voltage dividers.

Furthermore, the present embodiments can improve the speed by balancing the loads of the channels and reducing the line resistance value, thereby implementing a high-speed and high-resolution display device.

While various embodiments have been described above, it will be understood to those skilled in the art that the embodiments described are by way of example only. Accordingly, the disclosure described herein should not be limited based on the described embodiments.

What is claimed is:

1. A source driver comprising:

a first channel group and a second channel group configured to output source driving signals;

a first gradation voltage divider configured to generate first gradation voltages using gamma reference voltages and provide the first gradation voltages to the first channel group; and a second gradation voltage divider configured to generate second gradation voltages having the same voltage range and the same level as the first gradation voltages using the gamma reference voltages, and provide the second gradation voltages to the second channel group, wherein the first gradation voltage divider is connected to a gamma reference voltage generator configured to provide the gamma reference voltages through first branch lines diverging from main gamma lines, and the second gradation voltage divider is connected to the gamma reference voltage generator through second branch lines diverging from the main gamma lines, wherein the first and second gradation voltage dividers respectively receive the gamma reference voltages having the same voltage range from the gamma reference voltage generator, wherein the first branch lines and the second branch lines transfer the gamma reference voltages having the same voltage range to the first gradation voltage divider and the second gradation voltage divider, wherein channels allocated to the source driver integrated as one chip are grouped into the first channel group and the second channel group, wherein the first gradation voltage divider configured as a first resistor string and is connected one-to-one to the first channel group, and the second gradation voltage divider configured as a second resistor string and is connected one-to-one to the second channel group, and the first resistor string and the second resistor string are arranged in a center of two parts into which the channels are divided by a same number of channels.

2. The source driver of claim 1, wherein the first and second gradation voltage dividers generate the first and second gradation voltages having the same polarity and level using the gamma reference voltages.

3. The source driver of claim 1, wherein the first and second gradation voltage dividers generate the first and second gradation voltages independently of each other.

4. The source driver of claim 1, wherein the first channel group comprises odd channels among channels allocated to the source driver, and the second channel group comprises even channels among the channels.

5. The source driver of claim 1, wherein the first channel group comprises channels disposed on the left side based on the first and second gradation voltage dividers, and the second channel group comprises channels disposed on the right side based on the first and second gradation voltage dividers.

6. A display driving device comprising:

a gamma reference voltage generator configured to provide gamma reference voltages;

a first source driver comprising: a first gradation voltage divider configured to generate first gradation voltages using the gamma reference voltages and provide the first gradation voltages to a first channel group; and a second gradation voltage divider configured to generate second gradation voltages having the same voltage range and the same level as the first gradation voltage using the gamma reference voltages and provide the second gradation voltages to a second channel group; and a second source driver comprising: a third gradation voltage divider configured to generate third gradation voltages using the gamma reference voltages and provide the third gradation voltages to a third channel group; and a fourth gradation voltage divider configured to generate fourth gradation voltages the same voltage range and having the same level as the third gradation voltage using the gamma reference voltages and provide the fourth gradation voltages to a fourth channel group, wherein the first gradation voltage divider is connected to the gamma reference voltage generator through first branch lines diverging from main gamma lines, and the second gradation voltage divider is connected to the gamma reference voltage generator through second branch lines diverging from the main gamma lines, wherein the third gradation voltage divider is connected to the gamma reference voltage generator through third branch lines diverging from the main gamma lines, and the fourth gradation voltage divider is connected to the gamma reference voltage generator through fourth branch lines diverging from the main gamma lines, wherein the first to fourth branch lines transfer the gamma reference voltages having the same voltage range to the first to fourth gradation voltage dividers, wherein first channels allocated to the first source driver integrated as one chip are grouped into the first channel group and the second channel group and second channels allocated to the second source driver integrated as one chip are grouped into the third channel group and the fourth channel group, wherein the first gradation voltage divider configured as a first resistor string and is connected one-to-one to the first channel group, and the second gradation voltage divider configured as a second resistor string and is connected one-to-one to the second channel group, wherein the third gradation voltage divider configured as a third resistor string and is connected one-to-one to the third channel group, and the fourth gradation voltage divider configured as a fourth resistor string and is connected one-to-one to the fourth channel group, and the first resistor string and the second resistor string is arranged in the center of the two parts into which the channels are divided by a same number of channels in the first source driver, and the third resistor string and the fourth resistor string is arranged in a center of two parts into which the channels are divided by a same number of channels in the second source driver.

7. The display driving device of claim 6, wherein the first to fourth gradation voltage dividers respectively receive the gamma reference voltages having the same voltage range from the gamma reference voltage generator.

8. The display driving device of claim 6, wherein the first to fourth gradation voltage dividers generate the first to fourth gradation voltages having the same polarity and level using the gamma reference voltages.

9. The display driving device of claim 6, wherein the first to fourth gradation voltage dividers generate the first to fourth gradation voltages independently of one another.

10. The display driving device of claim 6, wherein the first channel group comprises first odd channels among first channels allocated to the first source driver, and the second channel group comprises first even channels among the first channels, wherein the third channel group comprises second odd channels among second channels allocated to the second source driver, and the fourth channel group comprises second even channels among the second channels.

* * * * *